US007443090B2

(12) United States Patent
Geis et al.

(10) Patent No.: US 7,443,090 B2
(45) Date of Patent: Oct. 28, 2008

(54) SURFACE-EMISSION CATHODES HAVING CANTILEVERED ELECTRODES

(75) Inventors: Michael W. Geis, Acton, MA (US); Theodore H. Fedynyshyn, Sudbury, MA (US); Sandra J. Deneault, Waltham, MA (US); Keith E. Krohn, Chelmsford, MA (US); Theodore M. Lyszczarz, Concord, MA (US); Michael F. Marchant, N. Chelmsford, MA (US)

(73) Assignee: The Massachusetts Institute of Technology, Cambridge, MA (US)

( * ) Notice: Subject to any disclaimer, the term of this patent is extended or adjusted under 35 U.S.C. 154(b) by 323 days.

(21) Appl. No.: 11/237,637

(22) Filed: Sep. 28, 2005

(65) Prior Publication Data

US 2007/0090476 A1 Apr. 26, 2007

(51) Int. Cl.
*H01J 1/00* (2006.01)

(52) U.S. Cl. ..... 313/310; 313/326

(58) Field of Classification Search ..... 313/310, 313/326

See application file for complete search history.

(56) References Cited

U.S. PATENT DOCUMENTS 5,610,471 A 3/1997 Bandy et al.
5,729,094 A 3/1998 Geis et al. ..... 315/169.1
5,973,451 A 10/1999 Geis et al. ..... 313/495
6,437,360 B1 * 8/2002 Cho et al. ..... 257/10
7,256,535 B2 * 8/2007 Davidson et al. ..... 313/309
2002/0060516 A1 * 5/2002 Kawate et al. ..... 313/495

FOREIGN PATENT DOCUMENTS

GB 1275972 A 6/1972

OTHER PUBLICATIONS

Lee et al. "Tungsten nanowires and their field electron emission properties" Applied Physics Letters, AIP, American Institute of Physics, Melville, NY, 81(4): 745-747, Jul. 22, 2002.
Invitation to Pay Additional Fees and Partial International Search for International Application No. PCT/US2006/029281 (4 pages) Jan. 26, 2007.
Dittmer, G. "Electrical Conduction and Electron Emission of Discontinuous Thin Films", Jul. 4, 1971, p. 317-328.
Geis, M. et al. "A New Surface Electron-Emission Mechanism in Diamond Cathodes", *Nature*, Jun. 1998, pp. 421-425.
Geis, M. et al. "Heterojunction, Vacuum-Glass Field Effect Transistors" 2005 Fall Meeting of the Materials Research Society, Nov. 28-Dec. 1, 2005, Boston, Mass., pp. 1-2.

* cited by examiner

*Primary Examiner*—Mark Prenty
(74) *Attorney, Agent, or Firm*—Goodwin Procter LLP

(57) ABSTRACT

A surface-emission cathode formed on an insulating surface having cantilevered, i.e. "undercut," electrodes. Suitable insulating surfaces include negative electron affinity (NEA) insulators such as glass or diamond. The cathode can operate in a comprised vacuum (e.g., $10^{-7}$ Torr) with no bias on the electrodes and low vacuum electric fields (e.g., at least 10 V $cm^{-1}$). Embodiments of the present invention are inexpensive to fabricate, requiring lithographic resolution of approximately 10 micrometers. These cathodes can be formed over large areas for use in lighting and displays and are suitable for satellite applications, such as cathodes for tethers, thrusters and space-charging neutralizers.

28 Claims, 7 Drawing Sheets

SURFACE-EMISSION CATHODES HAVING CANTILEVERED ELECTRODES

STATEMENT REGARDING FEDERALLY SPONSORED RESEARCH

Work described herein was supported by Air Force Contract No. F19628-00-C-0002, awarded by the Air Force Office of Scientific Research. The Government has certain rights in the invention.

FIELD OF THE INVENTION

The present invention relates generally to surface-emission cathodes, and more specifically to surface-emission cathodes having cantilevered electrodes.

BACKGROUND OF THE INVENTION

A common approach to field emission uses an atomically sharp tip that concentrates electric field lines of an applied potential, thus effecting local geometric field enhancement at the cathode-vacuum interface. The enhanced field facilitates electrons' tunneling into vacuum through the steep energetic barrier at the emission surface. Arrays of geometric field enhancement cathodes generally require an applied potential of 20 to 200 V to obtain practical working current densities, i.e. greater than 1 mA/cm$^2$.

With reference to FIG. 1, another approach uses two electrodes 100, 100' placed on an insulating substrate 104, such as PYREX glass. When sufficient bias is placed across these electrodes 100, 100', electrons are emitted into the vacuum. The cathode efficiency, i.e., the ratio of the emitted current to the current flowing between the electrodes, for such an arrangement ranges from $1\times10^{-4}$ to $1\times10^{-2}$. The conduction band edge of such a material is higher than the vacuum energy level, so emission of conduction band electrons to vacuum from the bulk of the cathode body is energetically favored. However, in general there is a significant barrier to injection of electrons into the cathode material from a metal contact. If the semiconductor forms a Schottky diode on metals, then when an electric field is applied across the semiconductor, the dopant impurities become positively ionized and form a depletion region at the metal-semiconductor junction, giving rise to a local field enhancement. When nitrogen-doped diamond or $Cs_2Si_4O_9$ glass is used as the semiconductor instead of PYREX glass, the electric field at this junction is often greater than $10^7$ V/cm, sufficient to cause tunneling of electrons from the metal into the semiconductor and markedly increasing the cathode efficiency. Once the electrons are in the NEA semiconductor they can be emitted directly into vacuum.

Although excellent electron emission characteristics have been observed from known emitter structures, especially those incorporating cathode bodies of diamond and amorphous diamond-like materials, practical applications of these cathodes remain limited by the fabrication techniques required to achieve their geometry, bias currents that are often substantially larger than the emitted current, and an operating environment that typically requires a vacuum of less than $10^{-9}$ Torr. Accordingly, there is a need for surface-emitting cathodes that are inexpensive to fabricate, have emission currents that scale with area, and can operate with no gate bias voltage in a compromised vacuum.

SUMMARY OF THE INVENTION

In brief, the present invention relates to a surface-emission cathode formed on an insulating surface having cantilevered, i.e. "undercut," electrodes. Suitable insulating surfaces include NEA insulators such as glass or diamond. The cathode can operate in a comprised vacuum (e.g., $10^{-7}$ Torr) with no bias on the electrodes and low vacuum electric fields (e.g., at least 10 V cm$^{-1}$). Embodiments of the present invention are inexpensive to fabricate, requiring lithographic resolution of approximately 10 micrometers. These cathodes can be formed over large areas for use in lighting and displays and are suitable for satellite applications, such as cathodes for tethers, thrusters and space-charging neutralizers.

In one aspect, the present invention relates to a surface-emission cathode having an insulating surface and a first cantilevered electrode in proximity to the insulating surface, for example, within 100 nanometers of the insulating surface. The cathode may also include one or more additional electrodes that may be located on the same side of the insulating surface as the first electrode, the opposite side of the insulating surface, or both sides. The cathode may be operated in a compromised vacuum.

Suitable insulating surfaces include glass surfaces, silica surfaces, surfaces containing alkali ions (such as cesium), carbon surfaces (including diamond surfaces), and surfaces doped with nitrogen atoms (e.g., containing at least $1\times10^{17}$ nitrogen atoms). Materials capable of trapping positive charge within their volume or having a negative electron affinity are also particularly suited for use in embodiments of the present invention.

In one embodiment, the electrodes placed on the same side of the insulating surface are separated by a distance of 10 to 20 micrometers. The electrodes may optionally be interdigitated. The electrodes may be, for example, metal film electrodes made from, e.g., tungsten. In a further embodiment, the insulating surface is comprised of multiple layers of insulating materials, for example, a first layer containing alkali metal ions and a second layer depleted of metallic ions.

In another aspect, the present invention relates to a method for the fabrication of a surface-emission cathode. A spacer is formed on a provided insulator film, such as a glass film or a diamond film. The spacer may be formed from various materials, such as aluminum or molybdenum. A metal film is formed on the spacer and patterned to form an electrode. The spacer and metal film may be formed using, for example, electron beam evaporation. Suitable metals for the metal film include tungsten. The spacer is then etched (for example, using a phosphoric base solution) to form a cantilevered electrode.

In yet another aspect, the present invention relates to a method for operating a surface-emission cathode. A first cantilevered electrode is provided in proximity to an insulating surface having at least one additional electrode. A bias voltage is subsequently applied to one of the electrodes to cause electron emission.

In one embodiment, applying the bias voltage involves momentarily applying a negative bias voltage to an additional electrode to obtain electron emission from the grounded first electrode. In another embodiment, applying the bias voltage involves momentarily applying a positive bias voltage to the first electrode to obtain electron emission from the first electrode. In still another embodiment, applying the bias voltage involves momentarily applying a positive bias voltage to an additional electrode to obtain electron emission from the grounded first electrode.

In still another aspect, the present invention relates to a surface-vacuum field effect transistor having an insulating surface, a first electrode on a first side of the insulating surface, a second electrode on a first side of the insulating surface, and a third electrode on a second side of the insulating surface. Either or both of the first and second electrodes may be cantilevered over the insulating surface. In operation, a voltage is applied between the first and second electrodes to induce a current between the first and second electrodes. A bias voltage applied between the first and third electrodes modulates the current flow. In one embodiment, the insulating surface has a negative electron affinity.

The foregoing and other features and advantages of the present invention will be made more apparent from the description, drawings, and claims that follow.

BRIEF DESCRIPTION OF DRAWINGS

The advantages of the invention may be better understood by referring to the following drawings taken in conjunction with the accompanying description in which.

In the drawings, like reference characters generally refer to corresponding parts throughout the different views. The drawings are not necessarily to scale, emphasis instead being placed on the principles and concepts of the invention.

DETAILED DESCRIPTION OF THE INVENTION

In contrast to conventional field emission cathodes that rely on atomically sharp tips to enhance the electric field, the cathodes of the present invention rely on geometry to increase the emission area while maintaining sufficient electric field for emission through the use of a triple junction, metal-insulator-vacuum junction and the NEA properties of an insulating film. Avoiding atomically sharp tips reduces the occurrence of catastrophic arcing and melting.

Figure 1:
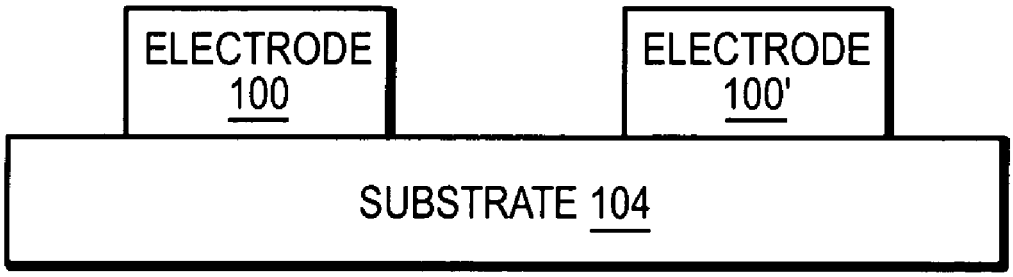
FIG. 1 PRIOR ART
FIG. 1 is a schematic cross-section of a prior art surface-emission cathode.
Figure 2:
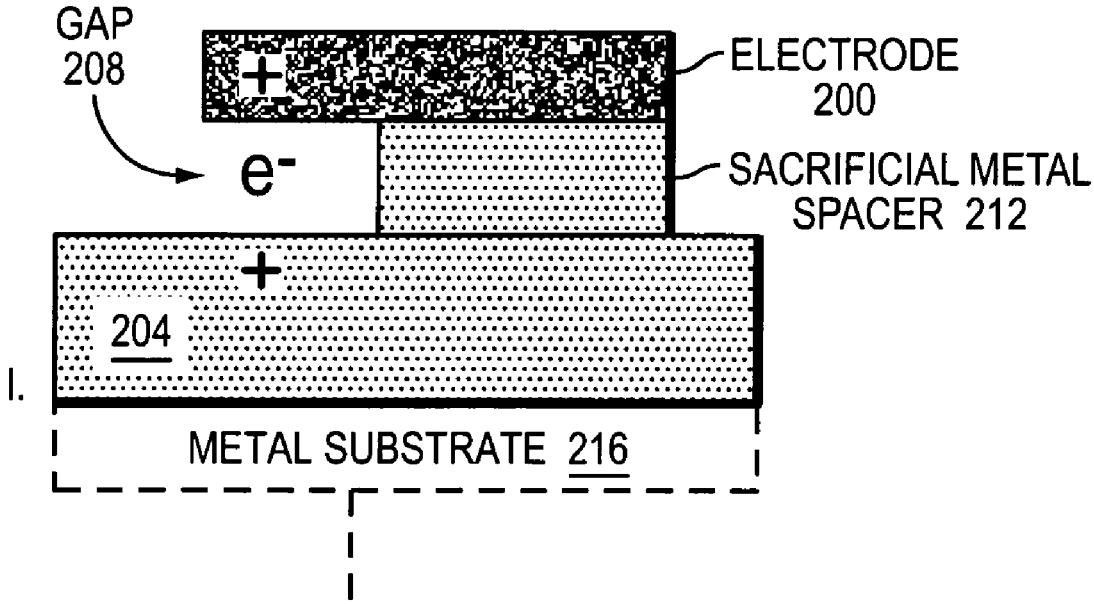
FIG. 2 is a schematic cross-section of one embodiment of a surface-emission cathode in accord with the present invention.

With reference to FIG. 2, one embodiment of the invention includes a metal electrode 200 placed over an insulator 204, typically a NEA insulator such as type-Ib diamond or $Cs_2Si_4O_9$ glass. The electrode 200 consists of a metal film, such as a tungsten film, separated from the insulator 204 by a gap 208 typically on the order of 0 to 70 nanometers. In this embodiment the gap is maintained by the use of a sacrificial metal spacer 212, e.g., an aluminum or molybdenum spacer, although other devices and arrangements for maintaining a space between the electrode and the insulator are contemplated by the present invention. The insulator 204 itself may be supported on an optional metallic substrate 216 to facilitate the application of a bias voltage.

When a bias voltage is applied across the electrode 200 and the insulator 204, it is believed that electrons tunnel from the metal electrode 200 onto the NEA insulator surface 204 and from there are thermally or ballistically emitted into vacuum. It is believed that the submicron gap between the electrode 200 and the insulating surface 204 significantly reduces the barrier for electrons to tunnel from the metal electrode 200 onto the insulator 204 through the combined image charges in the metal 200 and the insulator 204. A 9 nanometer gap lowers the tunneling barrier from the electrode 200 to the insulator surface 204 by approximately 10 percent and smaller gaps, i.e., less than one nanometer, can completely remove it.

Figure 3A:
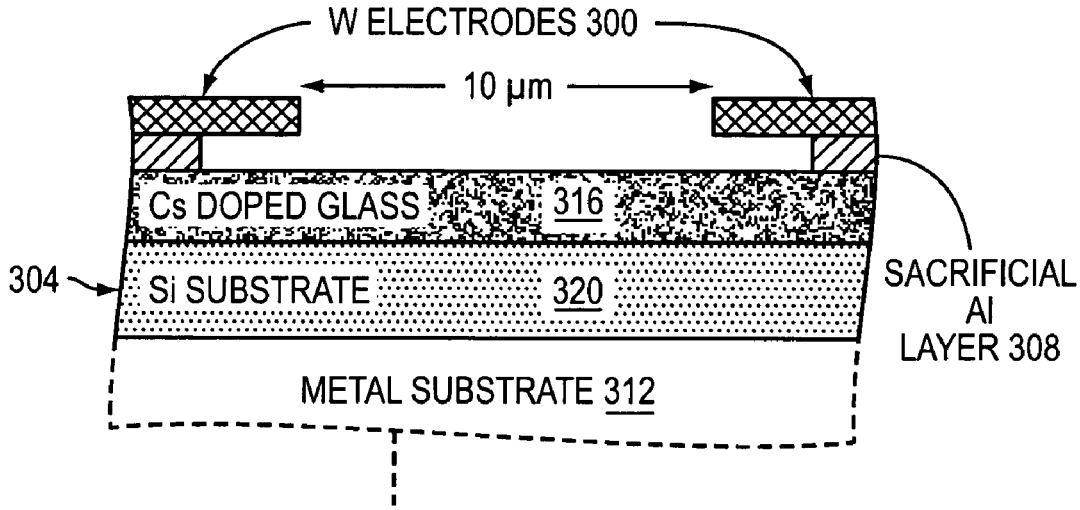
FIG. 3A is a schematic cross-section of a second embodiment of a surface-emission cathode in accord with the present invention.

With reference to FIG. 3A, a second embodiment of the invention includes two metal electrodes 300, 300' positioned over an insulator 304, typically a NEA insulator such as type-Ib diamond or $Cs_2Si_4O_9$ glass. The electrodes 300, 300' consist of a metal film, such as a tungsten film, separated from the insulator 304 by a gap typically on the order of 0 to 70 nanometers. The electrodes 300, 300' are themselves separated by approximately 10 to 20 micrometers.

As above, in this embodiment the gaps between the electrodes 300, 300' and the insulator 304 are maintained by the use of a metal spacer 308, e.g., an aluminum or molybdenum spacer, although other devices and arrangements for maintaining a space between the electrode and the insulator are contemplated by the present invention. The insulator 304 may be supported on an optional metallic substrate 312 to facilitate the application of a bias voltage or a voltage to modulate the current flowing between electrodes 300, 300'. As illustrated, the insulator 304 may itself be composed of a plurality of layers, such as a layer of cesium-doped glass 316 sandwiched with a layer of silicon substrate 320.

Electron emission is initiated by the application of a bias voltage between the electrodes 300, 300'. After the application of the bias voltage, it is believed that the electrons tunnel from the metal film electrode 300 onto the insulator surface 304 in the gap region, i.e., the region below the electrode 300. Once on the surface of the insulator 304, the image charge binding energy of electrons on the insulator surface (approximately 0.4 eV) is too low to keep the electrons from being thermally or ballistically emitted into vacuum. As above, it is believed that the gap between the insulator 304 and the electrodes 300, 300' and the use of an NEA insulator allows the emitted current to be many orders of magnitude larger than the bias current.

When one cathode electrode 300 is positively biased and the other electrode 300' is grounded, the electrons are emitted from the most negative (i.e., the grounded) cathode electrode 300', and the majority of the electrons arrive at the anode electrode 300 in spite of the higher electric field at the positive electrode 300, suggesting that the electrons have sufficient ballistic energy to overcome the gate electric field.

The most negative (i.e., the grounded) cathode electrode 300' is consistently the source of electrons for cathodes having a diamond insulator because of the positive charge that accumulates in the diamond under the electrode. In glass cathodes, however, the initial emission current comes from the most negative electrode, but with time or reduction of the bias voltage, the most positive electrode often becomes the primary source of emitted current.

With further reference to FIG. 3A, in some embodiments electron emission continues even without a sustained bias voltage. It is believed that the application of the bias voltage traps positive charge in the insulator 304 and that the trapped charge subsequently supplies a sufficient electric field to pull electrons out of the metal electrode 300 onto the insulator surface 304 and allows for the continued emission of electrons after the removal of the bias voltage. Measurable electron emission continues for anode voltages as low as 20 volts (i.e., an average surface electric field of less than 10 V $cm^{-1}$).

Not all embodiments of the present invention continue to emit electrons after the removal of the bias voltage. It is the believed that the following factors aid continued emission in the absence of a bias voltage: keeping the thickness of the glass as thin as possible (approximately one micrometer) without shorting to the substrate; keeping the glass substrate as smooth as possible (particularly during reactive-ion etching); and the application of a positive basis to the silicon substrate while keeping the cathode electrodes grounded.

Figure 3B:
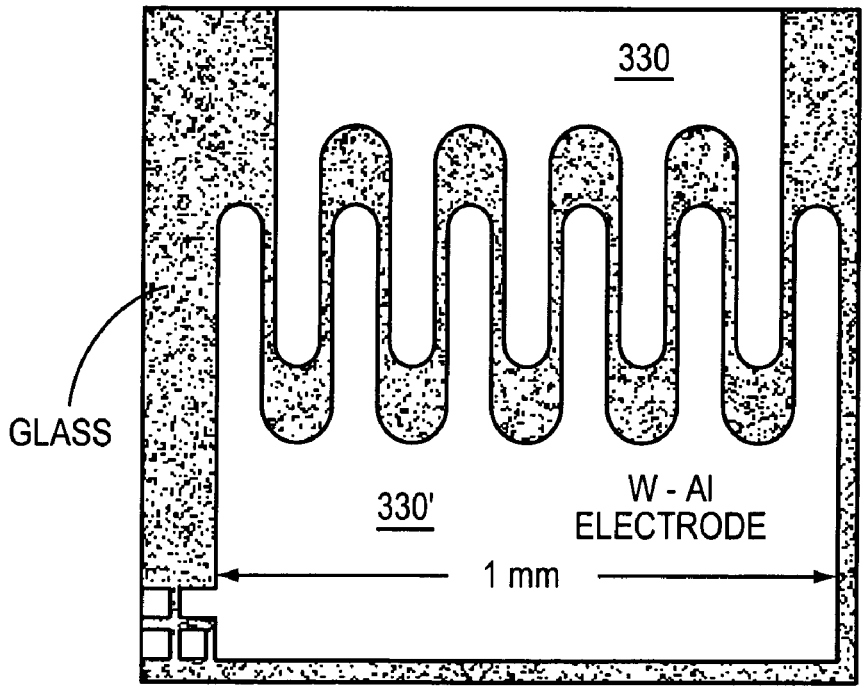
FIG. 3B is an optical micrograph of a further embodiment of the cathode of FIG. 3A having interdigitated electrodes.
Figure 4:
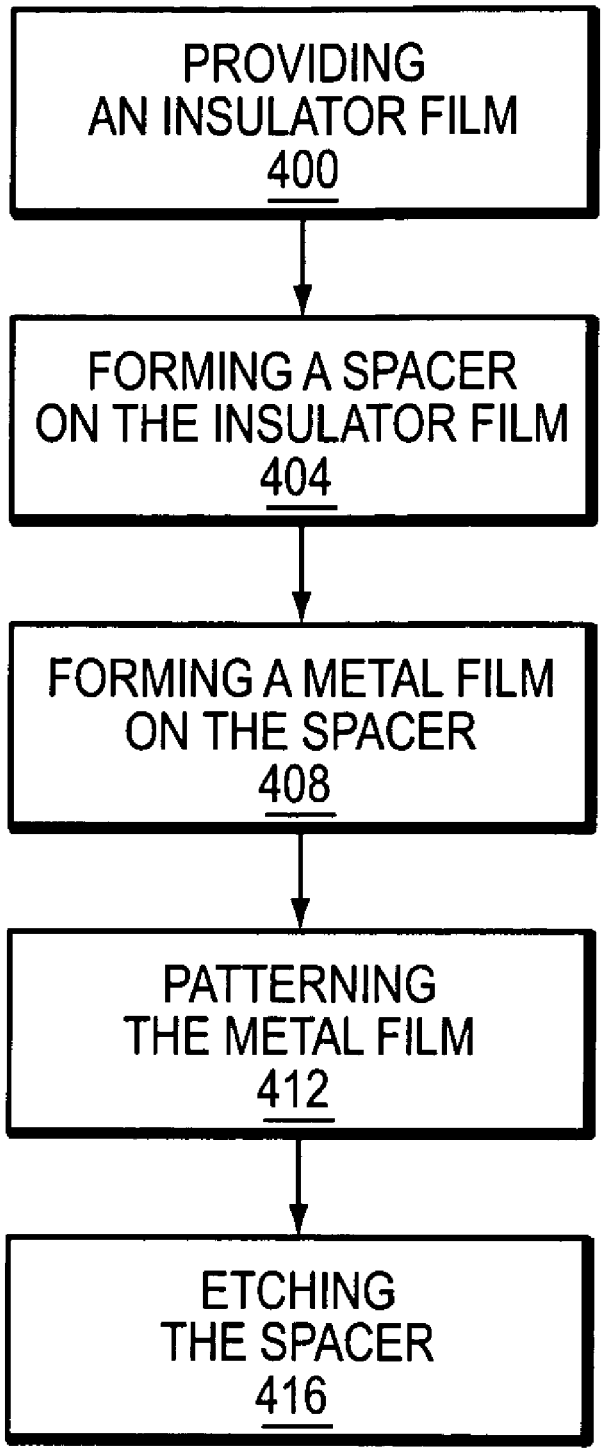
FIG. 4 is a flowchart of a manufacturing process for making a surface-emission cathode in accord with the present invention.

As illustrated in FIG. 3B, a further embodiment of the present invention utilizes interdigitated electrodes 330, 330' deposited on an insulator, e.g., such as high-pressure nitrogen-doped diamonds or silicon wafers coated with an NEA glass. The interdigitated electrodes are themselves separated by a gap of approximately 10 to 20 micrometers.

Fabrication

As discussed above, embodiments of the present invention are suited to fabrication on an NEA insulator, such as silicon wafers coated with an NEA glass (e.g., $Cs_2Si_4O_9$ glass). In one embodiment, the $Cs_2Si_4O_9$ glass layers are formed by spinning a water-based mixture of 20 nanometer silicon dioxide colloids and cesium hydroxide on silicon wafers previously coated with a layer of thermal silicon dioxide ranging from 100 nanometers to 1 micrometer in thickness. The resulting film is prebaked to 200 degrees Celsius, transferred without cooling to an oven ramped to 800 degrees Celsius, and subsequently allowed to cool to room temperature (Step 400). The resulting film of $Cs_2Si_4O_9$ glass is approximately 0.8 micrometers thick.

Next, approximately 70 nanometers of aluminum and 150 to 300 nanometers of tungsten are electron beam evaporated to form the spacer (Step 404) and electrode(s) (Step 408). The tungsten film is patterned using standard lithography and reactive-ion etching (Step 412). The tungsten film is then undercut to form the electrode(s) by etching the aluminum in a commercial phosphoric base solution (Step 416). The photoresist used to pattern the tungsten film is removed using reactive-ion etching to avoid contamination from organic solvents. The resulting sample is stored in dry nitrogen. Electrical contact to the back of the substrate is made using, for example, silver paint or electron beam evaporated titanium.

Prior to testing, the cathodes are subjected to an oxygen plasma, rinsed in deionized water, and baked to approximately 200 degrees Celsius for over twelve hours. Diamond cathodes may optionally be coated with cesium to enhance emission. Coating glass cathodes with additional cesium, other than that already in the glass, reduces emission.

Testing and Results

Testing is performed in an oil free cryo-pumped vacuum system at a pressure consisting primarily of $1\times10^{-6}$ to $1\times10^{-7}$ Pascals of water vapor. Measurements are made with the cathode substrate and one electrode grounded.

Figure 5:
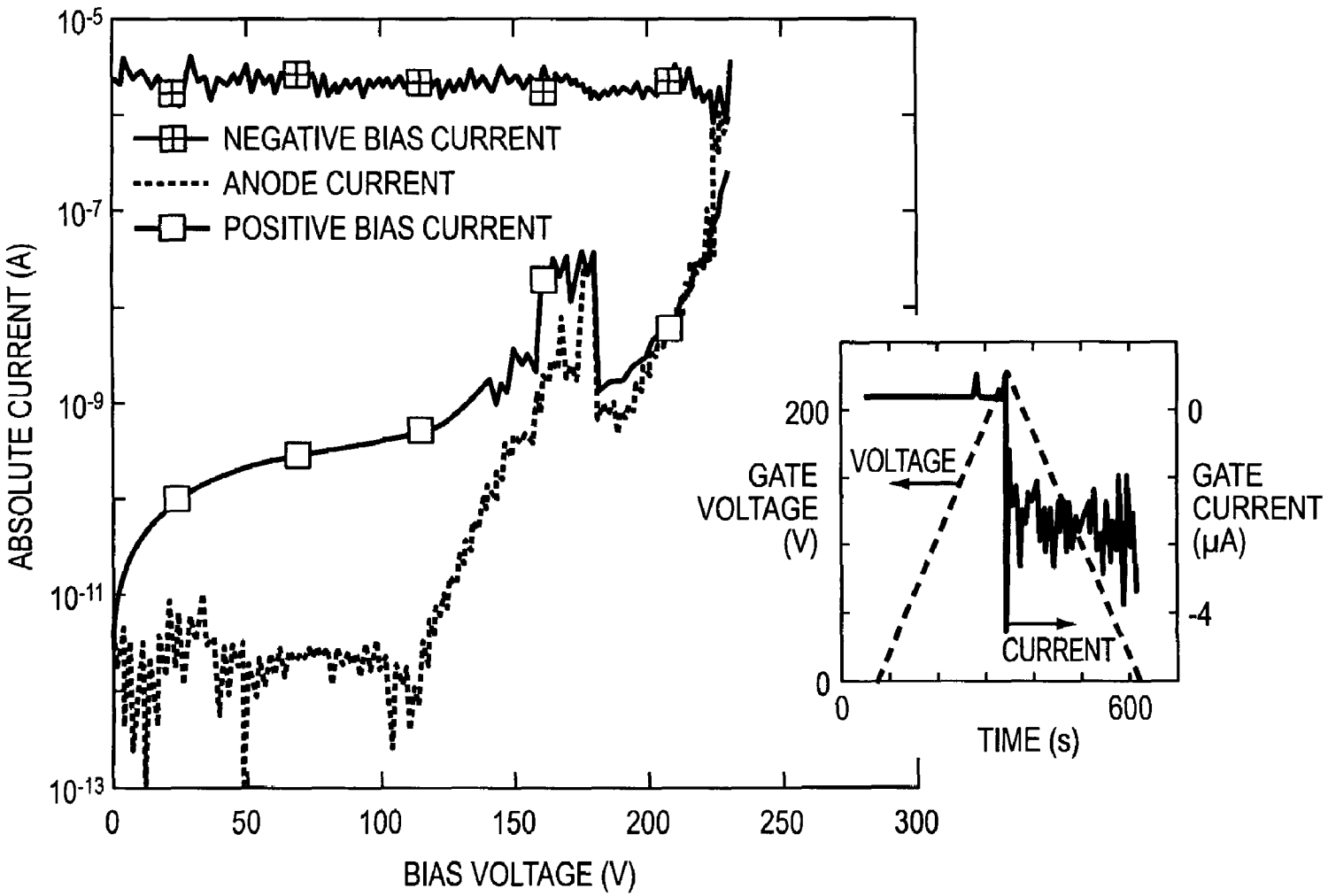
FIG. 5 is a graph of the electrical properties of a cathode in accord with the present invention during its first testing.
Figure 6:
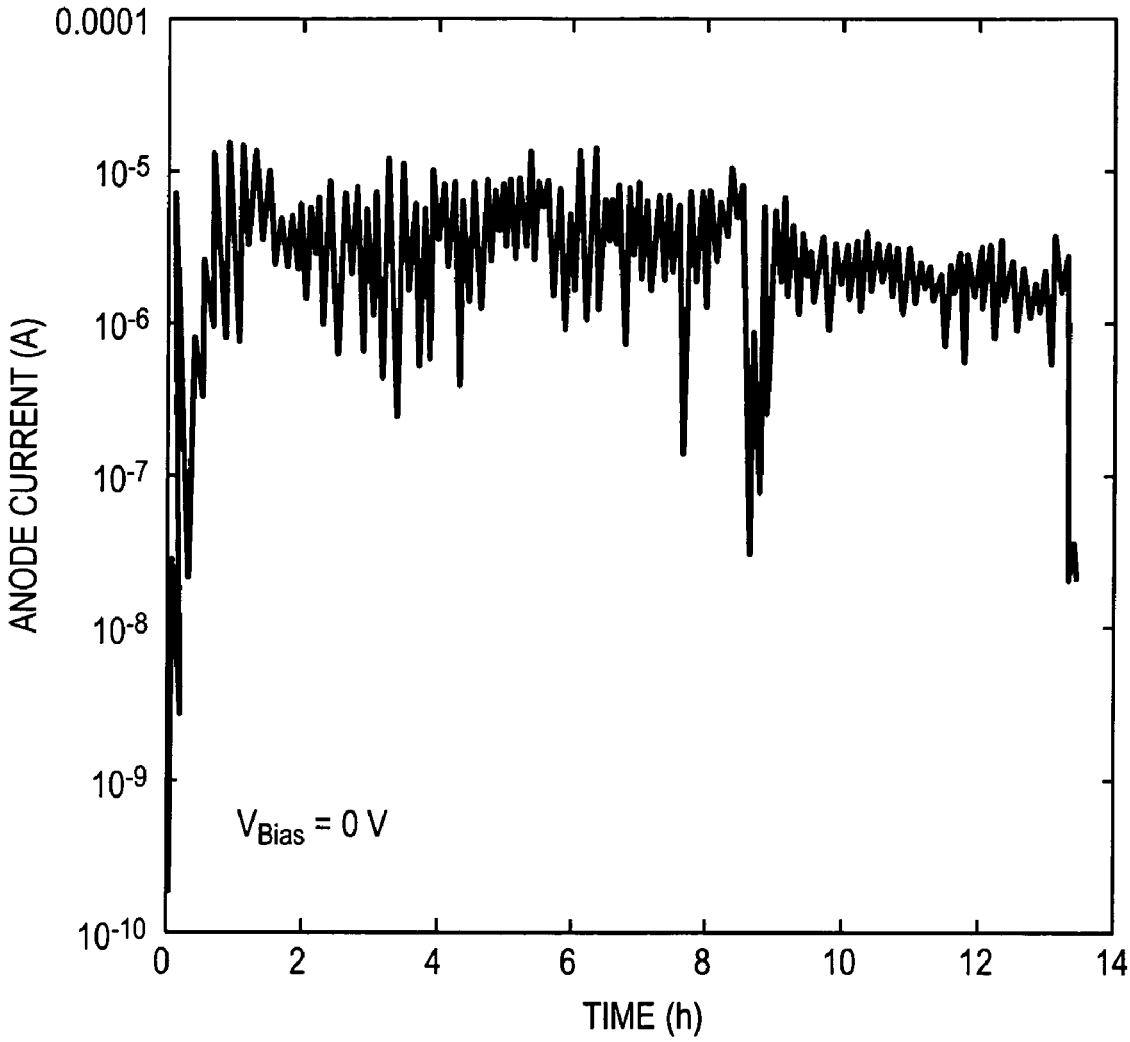
FIG. 6 is a graph of the cathode emission current of a cathode in accord with the present invention after the removal of the bias voltage.

FIG. 5 summarizes the electrical properties of glass cathodes measured during initial testing. As the bias voltage applied to the other electrode is increased to 110 volts, measurable emissible current (i.e., greater than $5\times10^{-12}$ amps) is detected and quickly increases to one microamp. After the bias voltage reaches 210 volts, it is decreased to zero volts. As FIG. 5 indicates, the electrode remains positively biased, but its current changes sign and remains equal in amplitude to the anode current. The inset shows bias voltage and bias current as a function of time; the bias current remains negative as long as the anode voltage is positive. Once emission is initiated it can continue for several hours without the restoration of the bias voltage, as shown in FIG. 6.

Figure 7:
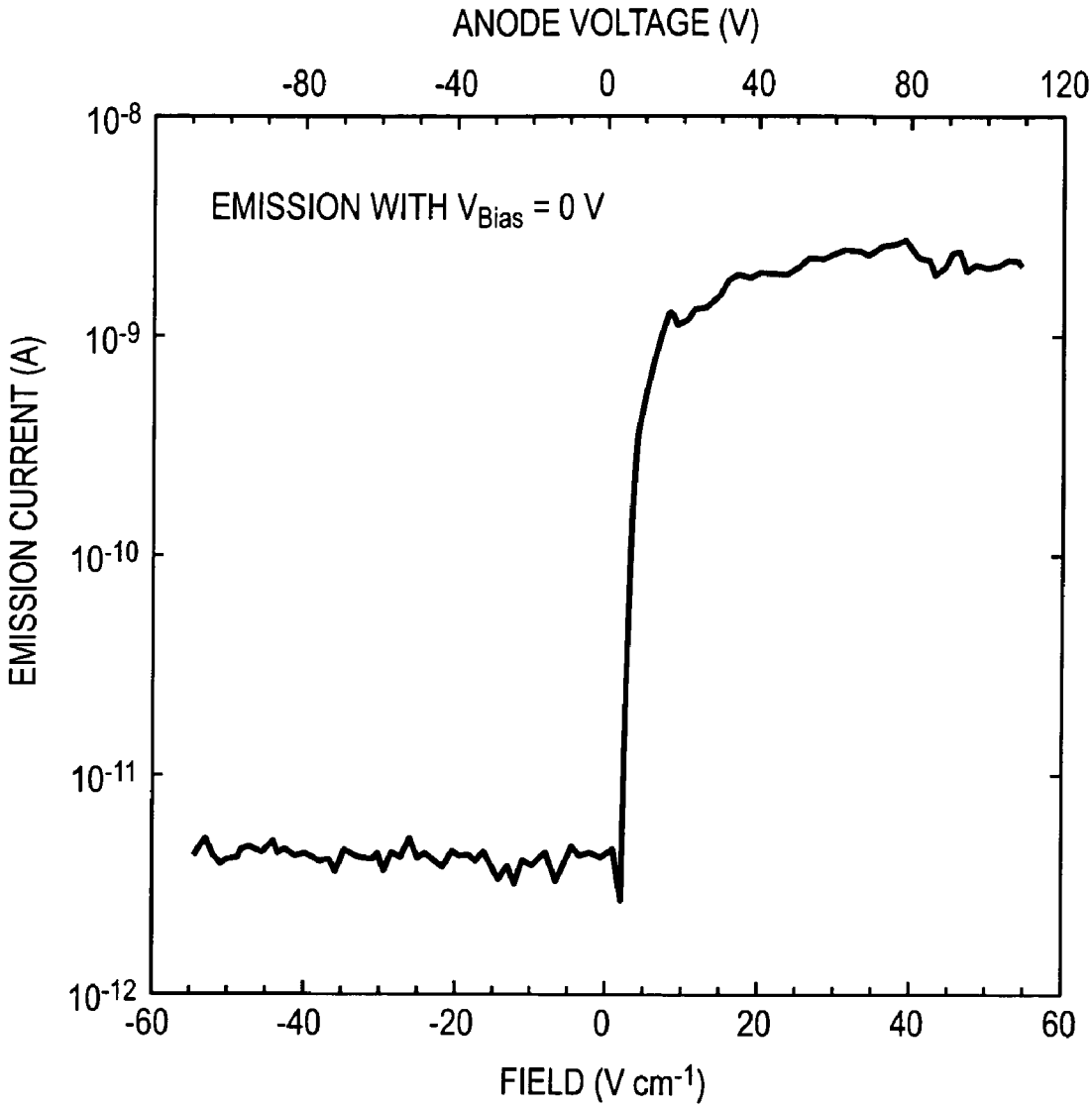
FIG. 7 is a graph of the anode current of a cathode in accord with the present invention as a function of anode voltage and surface electric field.
Figure 8:
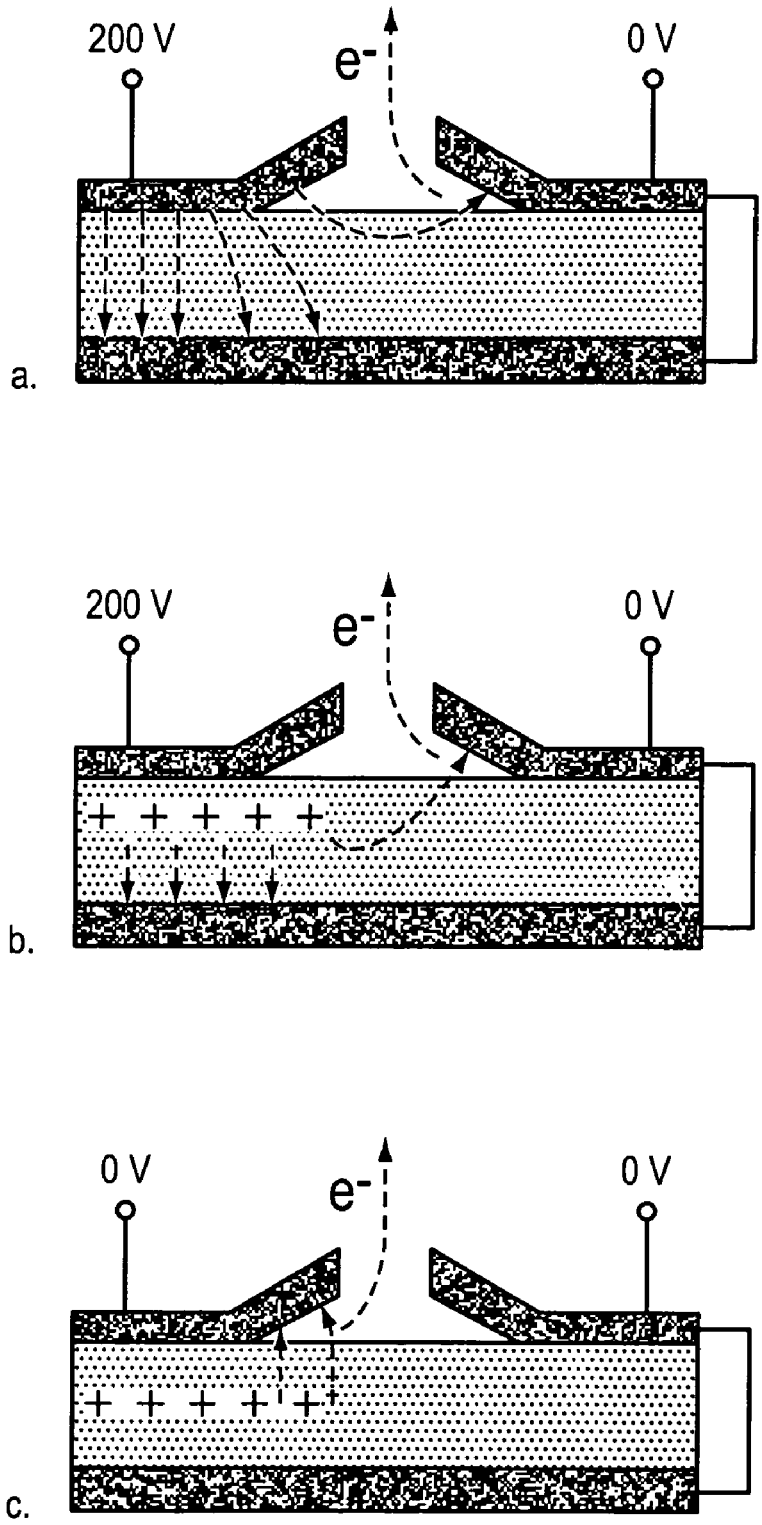
FIG. 8 is a schematic cross section of a cathode in accord with the present invention indicating the distribution of charge and electric field as one electrode is biased and then grounded.

Varying the anode voltages allows for the measurement of the energy of the emitted electrons. FIG. 7 illustrates the energies measured for an anode consisting of a one millimeter diameter wire placed one centimeter above and parallel to the cathode surface. A measurable emission current was obtained for anode voltages as low as 20 volts, which represents an average surface electric field at the cathode of less than 10 V $cm^{-1}$. With the anode at 1000 volts, the exposed glass substrate charges up to several hundred volts during emission. As discussed above, it is believed that this is the result of positive ions from the anode and may be related to the continued emission of electrons in the absence of the bias voltage. As illustrated in FIG. 8, it is believed that the reduction of the bias voltage changes the direction of the electric field and pulls electrons out of the previously more positive electrode.

It will therefore be seen that the foregoing represents a highly advantageous approach to the construction of field-emission devices, especially those incorporating diamond and other wide-bandgap materials. The terms and expressions employed herein are used as terms of description and not of limitation and there is no intention, in the use of such terms and expressions, of excluding any equivalents of the features shown and described or portions thereof, but it is recognized that various modifications are possible within the scope of the invention claimed. For example, although the aforementioned embodiments only explicitly illustrate the use of one or two electrodes, further embodiments of the present invention may have several such electrodes in various configurations and nothing in this discussion is intended to limit the scope of the present invention to a cathode having one or two electrodes.

Therefore, it must be expressly understood that the illustrated embodiments have been shown only for the purposes of example and should not be taken as limiting the invention, which is defined by the following claims. The following claims are thus to be read as not only literally including what is set forth by the claims but also to include all equivalents that are insubstantially different, even though not identical in other respects to what is shown and described in the above illustrations.

What is claimed is:

1. A surface-emission cathode comprising:

an insulating surface; and a first cantilevered electrode in proximity to the insulating surface, wherein the cathode is operated in a compromised vacuum.

2. The surface-emission cathode of claim 1 wherein the electrode is a metal film electrode.

3. The surface-emission cathode of claim 1 wherein the electrode is tungsten.

4. The surface-emission cathode of claim 1 further comprising an additional electrode.

5. The surface-emission cathode of claim 4 wherein the additional electrode is on the same side of the surface as the first electrode.

6. The surface-emission cathode of claim 5 wherein the electrodes on the same side of the surface are separated by 10 micrometers to 20 micrometers.

7. The surface-emission cathode of claim 5 wherein the electrodes on the same side of the surface are interdigitated.

8. The surface-emission cathode of claim 4 wherein the additional electrode is on the opposite side of the surface as the first electrode.

9. The surface-emission cathode of claim 4 wherein the additional electrode is on both sides of the insulating surface.

10. The surface-emission cathode of claim 1 wherein the first cantilevered electrode is less than 100 nanometers from the insulator.

11. The surface-emission cathode of claim 1 wherein the insulating surface is a glass.

12. The surface-emission cathode of claim 11 wherein the insulating surface contains silica.

13. The surface-emission cathode of claim 1 wherein the insulating surface contains alkali ions.

14. The surface-emission cathode of claim 13 wherein the insulating surface contains cesium.

15. The surface-emission cathode of claim 1 wherein the insulating surface contains carbon.

16. The surface-emission cathode of claim 15 wherein the insulating surface is diamond.

17. The surface-emission cathode of claim 16 wherein the insulating surface contains at least $1\times10^{17}$ nitrogen atoms.

18. The surface-emission cathode of claim 1 wherein the insulating surface has a negative electron affinity.

19. The surface-emission cathode of claim 1 wherein the insulating surface traps positive charge in its volume.

20. The surface-emission cathode of claim 1 wherein the insulating surface comprises a first layer containing alkali metal ions and a second layer depleted of metallic ions.

21. The surface-emission cathode of claim 20 wherein the surface of the first layer is directly below the cantilevered electrode and is in vacuum.

22. The surface-emission cathode of claim 1 wherein the insulating surface is less than 10 micrometers thick.

23. A method for operating a surface-emission cathode, the method comprising:

providing an insulating surface;

providing a first cantilevered electrode in proximity to the insulating surface;

providing an additional electrode; and applying a bias voltage to an electrode to cause electron emission comprising momentarily applying a positive bias voltage to the first electrode to obtain electron emission from the first electrode.

24. The method of claim 23 wherein applying the bias voltage further comprises momentarily applying a negative bias voltage to the additional electrode to obtain electron emission from the grounded first electrode.

25. The method of claim 23 wherein applying the bias voltage further comprises momentarily applying a positive bias voltage to the additional electrode to obtain electron emission from the grounded first electrode.

26. A surface-vacuum field effect transistor comprising:

an insulating surface;

a first electrode on a first side of the insulating surface;

a second electrode on a first side of the insulating surface; and a third electrode on a second side of the insulating surface, wherein the first electrode, the second electrode, or both, are cantilevered over the insulating surface.

27. The surface-vacuum field effect transistor of claim 26 wherein the insulating surface has a negative electron affinity.

28. The surface-vacuum field effect transistor of claim 26 wherein a voltage is applied between the first and second electrodes and induces a current between the first and second electrodes, said current being modulated by a bias voltage applied between the first and third electrodes.

* * * * *